US011577428B2

(12) United States Patent
Rice

(10) Patent No.: US 11,577,428 B2
(45) Date of Patent: Feb. 14, 2023

(54) VARIABLE DISPLACEMENT SELF LOADING MIXING DEVICE AND METHODS

(71) Applicant: Frank Warren Rice, Minneapolis, MN (US)

(72) Inventor: Frank Warren Rice, Minneapolis, MN (US)

( * ) Notice: Subject to any disclaimer, the term of this patent is extended or adjusted under 35 U.S.C. 154(b) by 1050 days.

(21) Appl. No.: 16/141,400

(22) Filed: Sep. 25, 2018

(65) Prior Publication Data

US 2019/0091891 A1 Mar. 28, 2019

Related U.S. Application Data

(60) Provisional application No. 62/606,436, filed on Sep. 25, 2017.

(51) Int. Cl.

| | |
|---|---|
| ***B28C 7/06*** | (2006.01) |
| ***B28C 5/42*** | (2006.01) |
| ***B28C 7/14*** | (2006.01) |
| ***B28C 5/14*** | (2006.01) |
| ***B28C 5/08*** | (2006.01) |
| ***B28C 5/12*** | (2006.01) |
| ***B01F 27/60*** | (2022.01) |
| ***B01F 33/502*** | (2022.01) |

(Continued)

(52) U.S. Cl.

CPC ..... *B28C 7/068* (2013.01); *B01F 27/60* (2022.01); *B01F 33/5021* (2022.01); *B01F 35/451* (2022.01); *B01F 35/71715* (2022.01); *B28C 5/0812* (2013.01); *B28C 5/0893* (2013.01); *B28C 5/1223* (2013.01); *B28C 5/148* (2013.01); *B28C 5/4213* (2013.01); *B28C 5/4231* (2013.01); *B28C 5/4244* (2013.01); *B28C 5/4282* (2013.01); *B28C 7/14* (2013.01)

(58) Field of Classification Search

CPC ..... B28C 7/068; B28C 7/0858; B28C 7/14; B28C 5/4241; B01F 35/7178; B01F 35/71715; E02F 3/342; E02F 3/358; E02F 3/404; E02F 3/407; A01K 5/001; A01K 5/002; A01F 25/2027

USPC ..... 366/8

See application file for complete search history.

(56) References Cited

U.S. PATENT DOCUMENTS 3,246,884 A * 4/1966 Prichard ..... B28C 5/4203 280/43.23

5,261,739 A * 11/1993 da Costa Goncalves ..... B28C 7/0858 37/304

2016/0198677 A1* 7/2016 Van Den Berg ..... A01K 5/004 119/61.2

* cited by examiner

*Primary Examiner* — Elizabeth Insler

(74) *Attorney, Agent, or Firm* — Alan D. Kamrath; Mayer & Williams PC

(57) ABSTRACT

A device for loading, mixing and delivering ingredients includes a measuring bucket pivotably mounted to the free ends of pickup arms pivotably mounted to a mixing vessel including a lid having a depressed basin with an opening formed therethrough. The mixing vessel and the measuring bucket are simultaneously moved with the measuring bucket in a loading position to fill with ingredients. The measuring bucket is moved relative to the mixing vessel from a transport position to an emptying position emptying the ingredients into the mixing vessel. A linkage is pivotably mounted between the pickup arms and the lid to simultaneously move the lid from a closed position to an open position as the measuring bucket moves from the transport position to the emptying position. The ingredients are mixed by mixing paddles inside the mixing vessel, and the mixed ingredients are released from the mixing vessel through an open gate.

15 Claims, 7 Drawing Sheets

(51) Int. Cl.
*B01F 35/45* (2022.01)
*B01F 35/71* (2022.01)

VARIABLE DISPLACEMENT SELF LOADING MIXING DEVICE AND METHODS

BACKGROUND

A variable displacement self loading mixing device and methods are shown and described.

Small batches of concrete are typically mixed in a cement mixer that is hand loaded with material and then dumped into a wheel barrow which is moved to the desired location for dumping. Considerable labor is required, much of which is manually performed by multiple persons.

Thus, a need exists for methods and devices for loading, mixing and delivering concrete which mechanizes many steps and reduces labor requirements with fewer personnel.

SUMMARY

The above and further needs have been overcome by providing methods and devices for loading, mixing and delivering ingredients such as for cement. Specifically, a mixing vessel is moveably positioned vertically, horizontally and angularly with respect to ground, with the mixing vessel including an open, upper peripheral edge and a gate moveable between a closed position and an open position allowing communication with an interior of the mixing vessel. A measuring bucket is positioned relative to the mixing vessel, with the measuring bucket including an open top and a closed bottom. The measuring bucket is moved to a loading position with the measuring bucket abutting the ground, with the open top generally perpendicular to the ground, and with the closed bottom intermediate the open top and the mixing vessel while the measuring bucket and the mixing vessel are simultaneously moved into a pile of ingredients to fill the measuring bucket with the ingredients. The measuring bucket filled with the ingredients is moved relative to the mixing vessel to a transport position with the measuring bucket spaced from and parallel to the mixing vessel with the open top above the closed bottom. The measuring bucket is moved from the transport position to an emptying position with the open top located within the upper peripheral edge and with the open top intermediate the closed bottom and the mixing vessel, emptying the ingredients from the measuring bucket into the mixing vessel. The ingredients in the mixing vessel are mixed, such as by rotating mixing paddles extending radially from a shaft and inside the interior of the mixing vessel. After moving the mixing vessel to a dispensing location, the gate is opened allowing flow of the mixed ingredients from the interior of the mixing vessel.

In a further aspect, a lid is simultaneously moved from a closed position abutting with the open, upper peripheral edge and closing the interior of the mixing vessel to an open position spaced from the open, upper peripheral edge as the measuring bucket moves from the transport position to the emptying position. In further aspects, the lid includes a peripheral rim and an arcuate basin depressed within the peripheral rim and located opposite to the interior when the lid is in the closed position, with the arcuate basin including an opening in communication with the interior of the mixing vessel in the closed position, with liquid contained in the arcuate basin emptying into the mixing vessel as the lid moves from the closed position to the open position.

Illustrative embodiments will become clearer in light of the following detailed description described in connection with the drawings.

DESCRIPTION OF THE DRAWINGS

The illustrative embodiments may best be described by reference to the accompanying drawings where.

Figure 1:
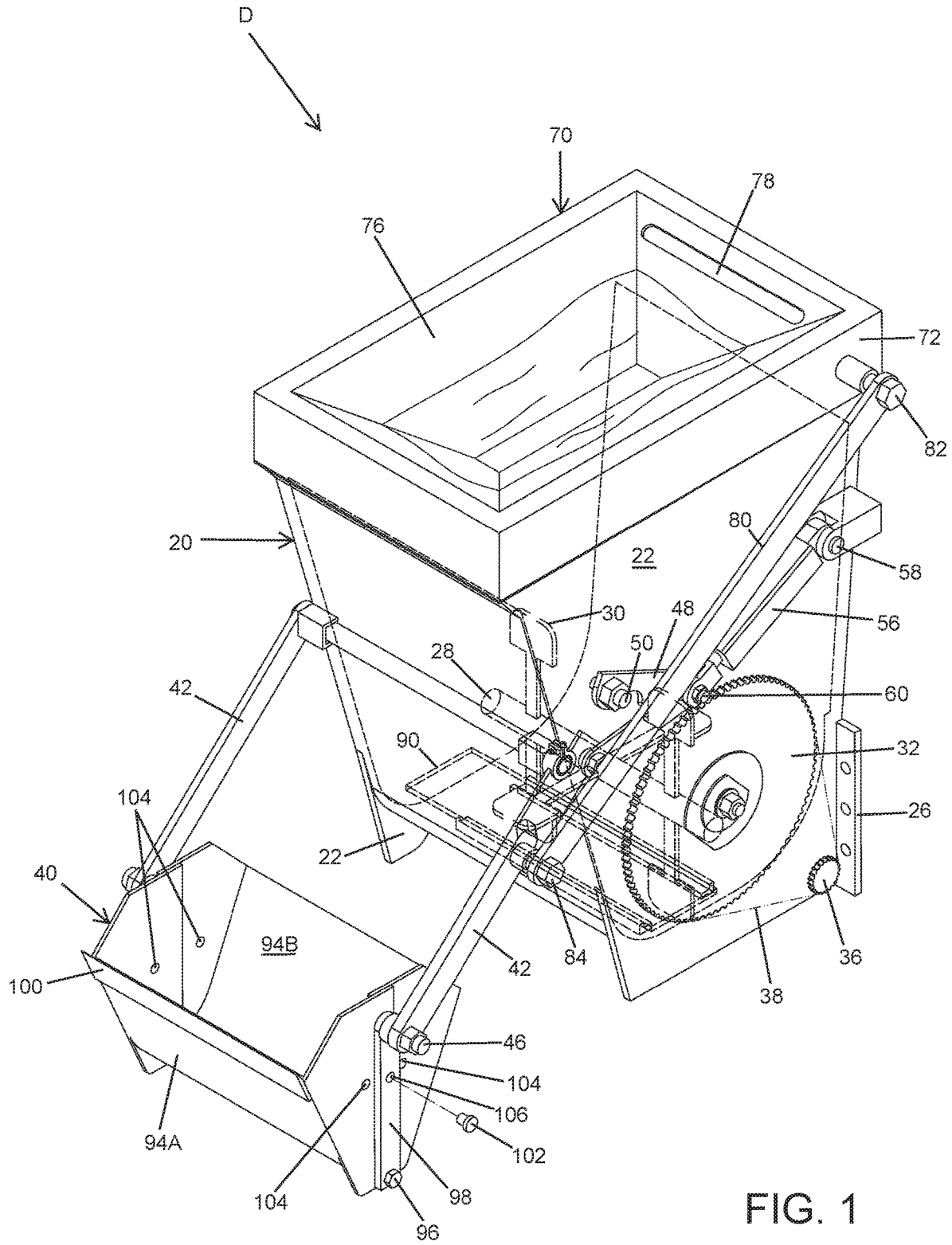
FIG. 1 shows a perspective view of a variable displacement self loading mixing device.
Figure 2:
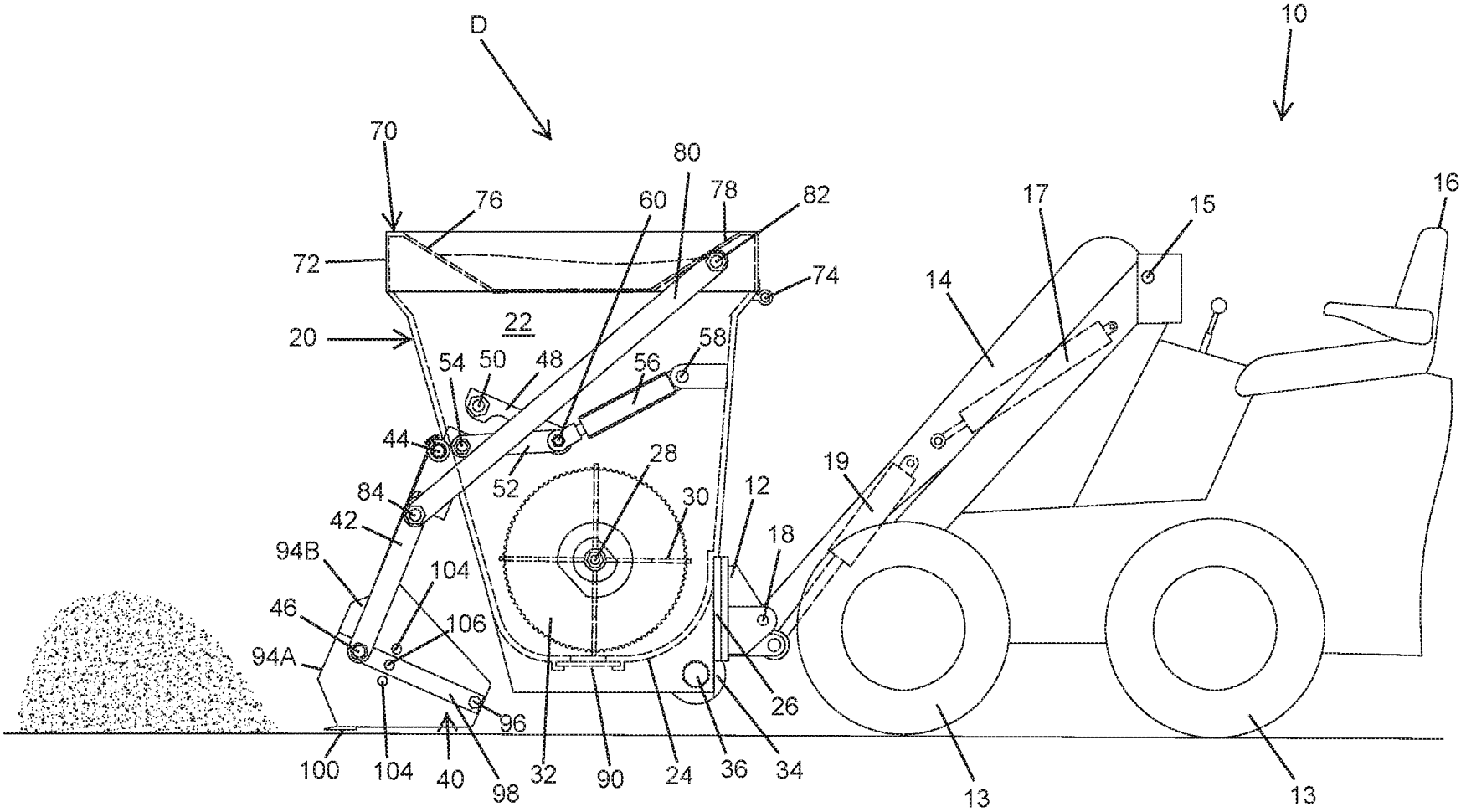
FIGS. 2-7 show side views illustrating a method of loading, mixing and delivering cement.
Figure 3:
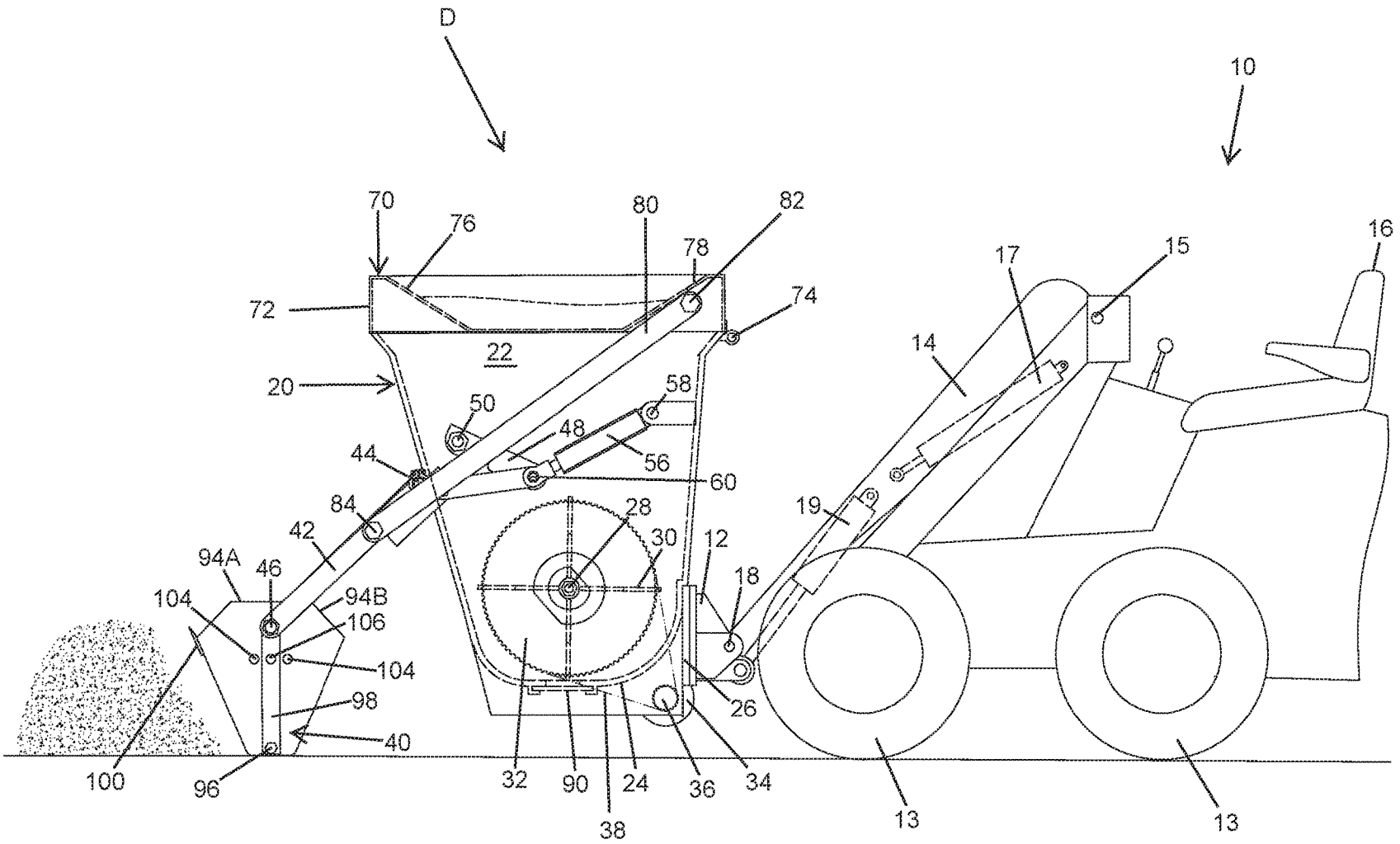
Figure 4:
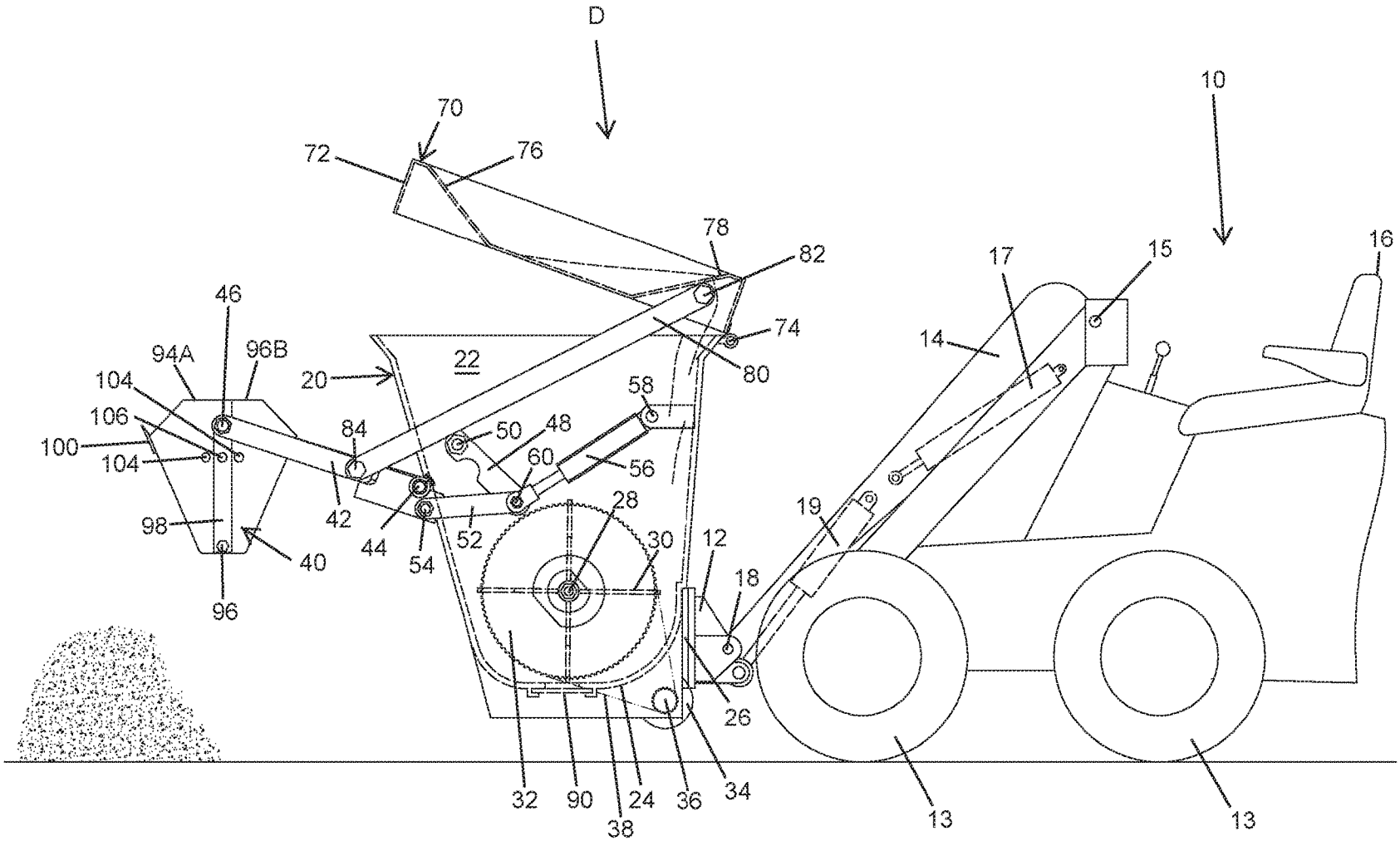
Figure 5:
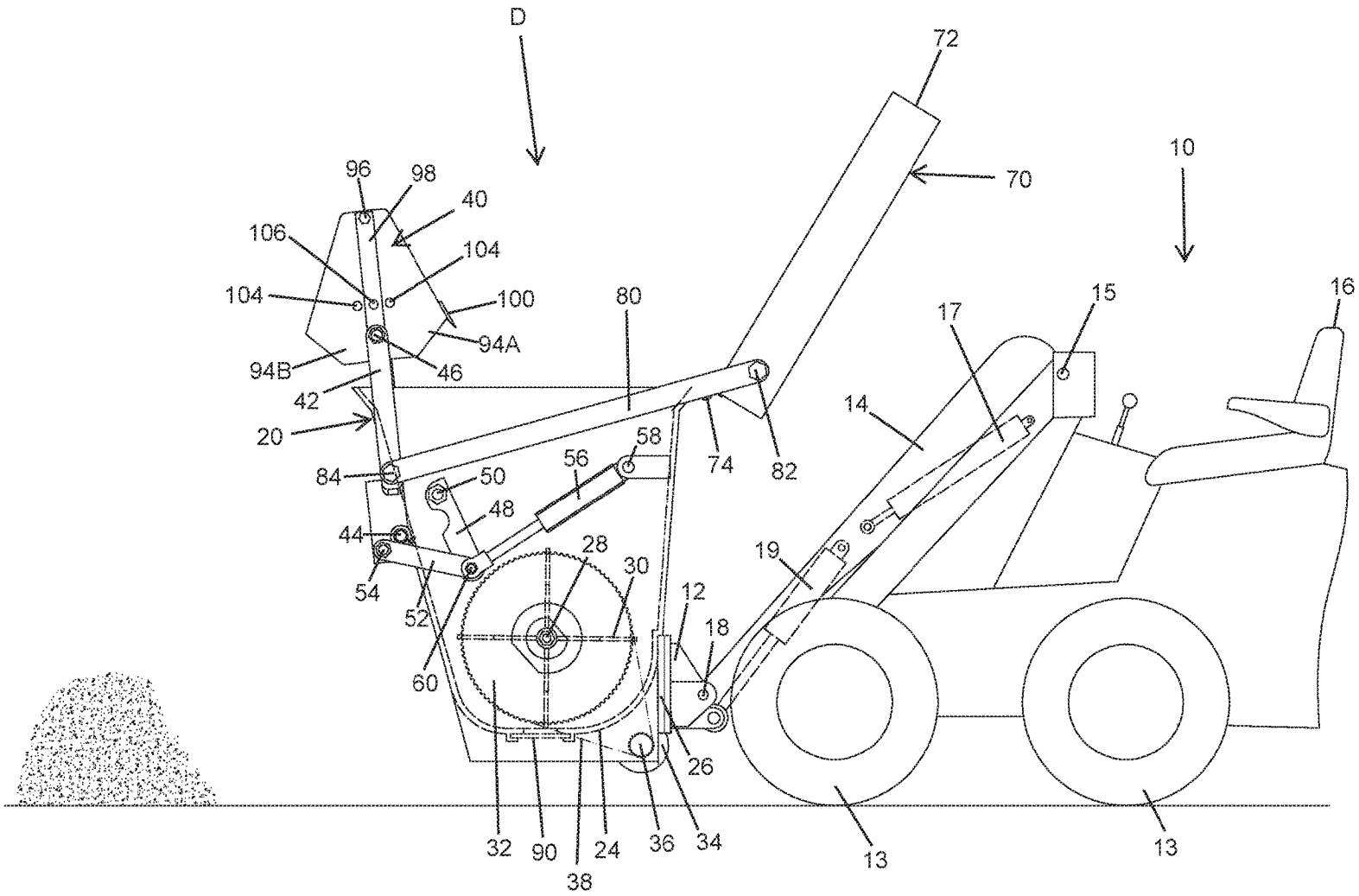
Figure 6:
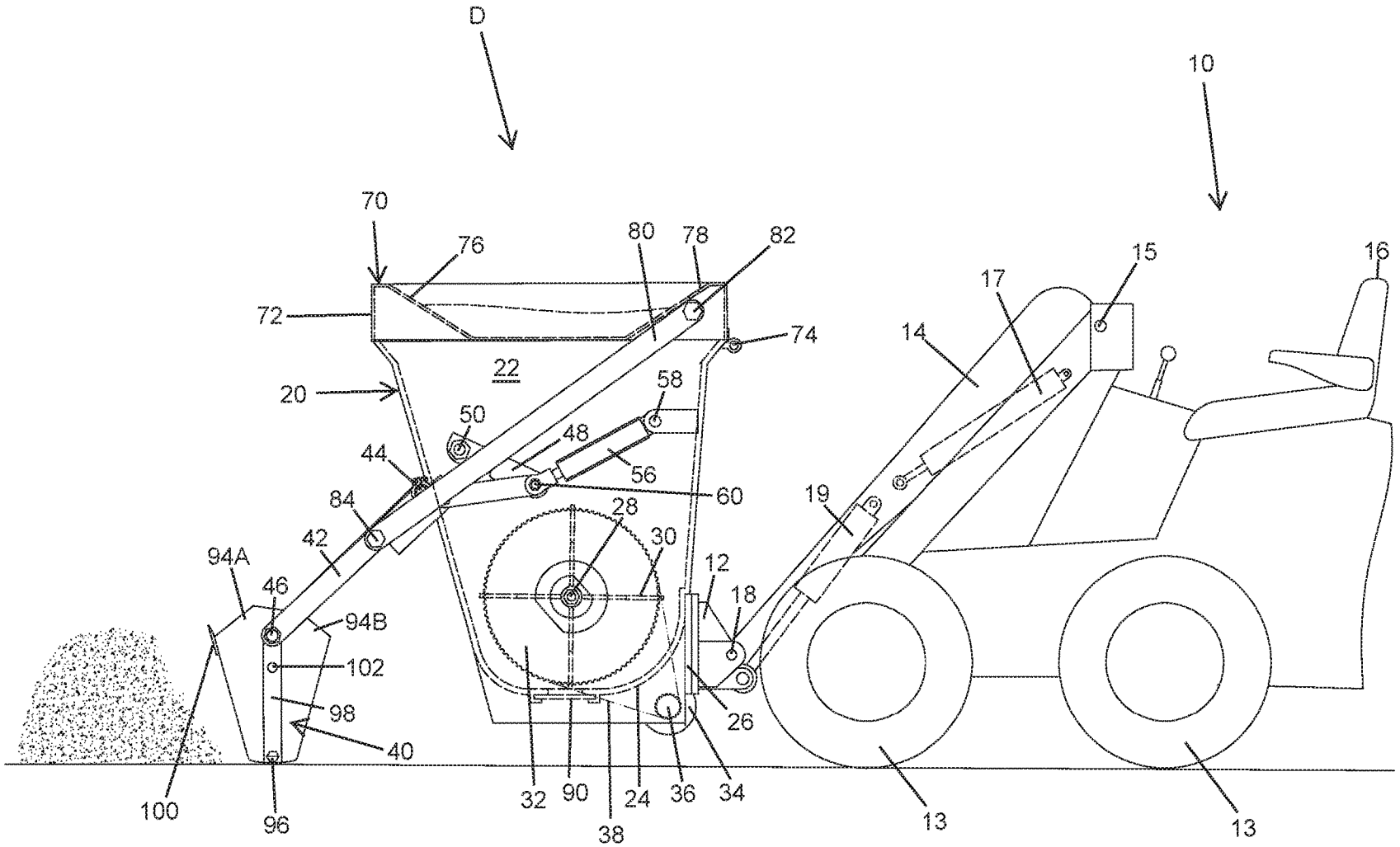

All figures are drawn for ease of explanation of the basic teachings of the present invention only; the extensions of the figures with respect to number, position, relationship, and dimensions of the parts to form the preferred embodiments will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in the various figures of the drawings, the same numerals designate the same or similar parts. Furthermore, when the terms "top", "bottom", "first", "second", "forward", "rearward", "reverse", "front", "back", "height", "width", "length", "end", "side", "horizontal", "vertical", and similar terms are used herein, it should be understood that these terms have reference only to the structure shown in the drawings as it would appear to a person viewing the drawings and are utilized only to facilitate describing the illustrative embodiments.

DESCRIPTION OF THE ILLUSTRATIVE EMBODIMENTS

A variable displacement self loading mixing device is shown in the drawings and generally designated D. Device D is intended to be mounted to a loader 10 including loader arms 14 pivotable about an axis 15 positioned relative to a cab 16. Movement of loader arms 14 is controlled with a control system including devices or mechanisms (not shown) operated by an operator in cab 16. In one exemplary implementation, the control system includes an electrohydraulic control system. In some embodiments, loader 10 includes hydraulic cylinders 17 that are actuatable using the control mechanisms in cab 16 to pivot loader arms 14 about axis 15. Pivoting loader arms 14 with respect to axis 15 moves the opposite ends of loader arms 14 vertically (i.e., along an axis perpendicular to the ground). Suitable provisions, such as wheels 13, are provided to move loader arms 14 horizontally (i.e. along an axis parallel to the ground).

Loader arms 14 also include a second axis 18, near the opposite ends of loader arms 14, about which an attachment base 12 can pivot. Movement of attachment base 12 of loader arms 14 is also controlled by an operator in cab 16. In some embodiments, loader 10 includes hydraulic cylinders 19 that are actuatable using the control mechanisms in cab 16 to pivot the attachment base 12 about axis 18.

Loader 10 shown is merely by way of example, and loader 10 can be of any type or style adaptable to connect with and control attachment base 12. Example manufacturers of loaders 10 of the skid type for use in conjunction with attachment base 12 include, but are not limited to, Bobcat, Case, Caterpillar, Waker Newson, LiuGong, Volvo, JohnDeere, MG, JCB, New Holland, Gehl Company, Mustang, ASV, Komatsu, and Hyundai. Additionally, the size of loader 10 is merely by way of example, and attachment base 12 and device D can be sized and configured for use with loaders 10 or other machinery of any size.

Generally, device D includes a mixing vessel 20 having spaced side plates 22 and a front, back, and bottom plate 24 of an arcuate shape extending between side plates 22, with plates 22 and 24 defining an open, upper peripheral edge. A mount 26 extends from side plates 22 for removable attachment to attachment base 12 of loader 10, such as by utilizing known quick type attachment mechanisms. A shaft 28 extends through the interior of mixing vessel 20 between side plates 22 and spaced concentrically inside plate 24. Mixing paddles 30 extend radially from shaft 28 and inside the interior of vessel 20. Shaft 28 is driven to rotate in any suitable manner. In the form shown, a gear 32 is attached to an end of shaft 28 outside of vessel 20. A motor 34, such as driven hydraulically, drives a gear 36 in gearing relation with gear 32 by a roller chain 38.

Device D further includes a measuring bucket 40 including an open top and a closed bottom. Suitable provisions are included for moving measuring bucket 40 relative to vessel 20 and between a loading position, a transport position, and an emptying position. Specifically, in the form shown, first and second pickup arms 42 are pivotably mounted to side plates 22 about an axis 44, and measuring bucket 40 is pivotable about the outer ends of pickup arms 42 about an axis 46 spaced from and parallel to axis 42. Suitable provisions are included for pivoting pickup arms 42 about axis 44. In the form shown, a first link 48 has a first end pivotable about an axis 50 relative to vessel 20. A second link 52 has a first end pivotable to one pickup arm 42 about an axis 54 spaced from and parallel to axis 44. An elongatable hydraulic cylinder 56 has a first end pivotable to vessel 20 about an axis 58 spaced from and parallel to axis 44. The second ends of links 48 and 52 and of hydraulic cylinder 56 are pivotably connected together about an axis 60 parallel to and spaced from axes 44, 50, 54, and 58.

Device D also includes a lid 70 for mixing vessel 20 having a peripheral rim 72 of a size and shape corresponding to the open, peripheral upper edge of mixing vessel 20. Lid 70 is pivotably mounted to mixing vessel 20 between closed and open positions. In the form shown, a hinge between the rear lower edge of peripheral rim 72 and the rear edge of the open, peripheral upper edge of mixing vessel 20 pivots lid 70 relative to mixing vessel 20 about an axis 74 which is parallel to and spaced from axes 44, 50, 54, 58 and 60 and which is at an opposite side of the open, upper peripheral edge of the mixing vessel 20 with measuring bucket 40 in the emptying position. In the closed position, peripheral rim 72 of lid 70 abuts with the open, upper peripheral edge of mixing vessel 20, closing the interior of mixing vessel 20. In the open position, lid 70 is spaced from the open, upper peripheral edge of mixing vessel 20. Lid 70 further includes an arcuate basin 76 extending inwardly and downwardly from peripheral edge 72 for holding liquid, such as water. Arcuate basin 76 is located opposite to the interior of mixing vessel 20 when lid 70 is in its closed position. The rear side of arcuate basin 76 includes an opening 78 located adjacent to, but spaced from, peripheral rim 72. Opening 78 is in communication with the interior of mixing vessel 20 when lid 70 is in its closed position. Lid 70 further includes a linkage 80 having a first end pivotably attached to peripheral rim 72 about an axis 82 and having a second end pivotably attached to one pickup arm 42 about an axis 84. Axes 82 and 84 are parallel to and spaced from each other and axes 44, 50, 54, 58, 60 and 74.

Mixing vessel 20 includes a closable gate 90 located in plate 24 below shaft 28 and mixing puddles 30. Gate 90 can be closed to allow mixing ingredients to be contained in mixing vessel 20 without leakage. Gate 90 can also be opened allowing flow of mixed ingredients out of the interior of mixing vessel 20. A chute can be provided movably connected to mixing vessel 20 for directing the mixed ingredients flowing out of open gate 90.

In the form shown, measuring bucket 40 is formed by first and second clam shells 94A and 94B which are pivotable relative to each other about an axis 96. Axis 96 extends through the lower ends of bars 98 extending vertically intermediate clam shells 94A and 94B. Axis 46 extends through the upper ends of bars 98, spaced slightly below the upper edges of clam shells 94A and 94B. The upper edge of clam shell 94A located outwardly of mixing vessel 20 includes a scraping blade 100. Shells 94A and 94B can be held in a fixed position relative to each other and bars 98 by pins 102 which extend through aligned apertures 104 in clam shells 94A and 94B and apertures 106 in bars 98. Clam shells 94A and 94B are expandable from a first position with pins 102 extending through apertures 104 and 106 to an intermediate position with pins 102 extending through apertures 106 and one aperture 104 but not the other aperture 104 and a maximum position with pins 102 not extending through apertures 104 and 106.

Figure 7:
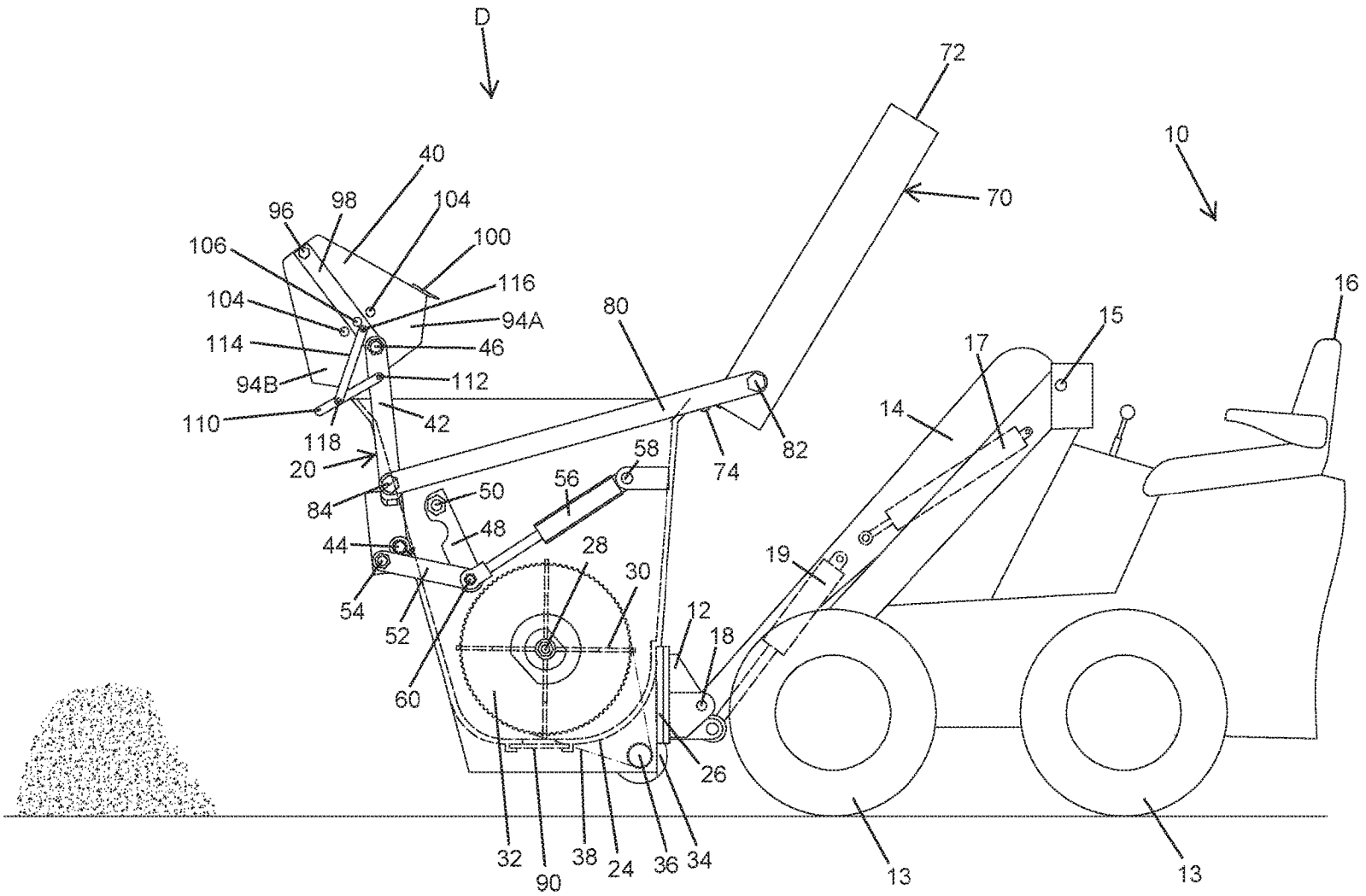

In an alternate form shown in FIG. 7, measuring bucket 40 further includes a cam follower 110 pivotably mounted to one pickup arm 42 about a follower axis 112 located intermediate, spaced from, and parallel to axes 44 and 46. A tie 114 has a first end pivotably mounted to one bar 98 about an axis 116 located intermediate, spaced from and parallel to axes 46 and 96 and has a second end pivotably mounted to follower 110 intermediate its ends about an axis 118 parallel to and spaced from axes 44, 46, 112 and 116. When measuring bucket 30 is moving from its transport position to its emptying position, cam follower 112 abuts with the open, upper peripheral edge of mixing vessel 30, with the open, upper peripheral edge of mixing vessel 30 acting as a cam to pivot measuring bucket 40 about axis 46 to raise the bottom ends of clam shells 94A and 94B to be above the upper ends of clam shells 94 A and 94B within the open, upper peripheral edge and above the mixing vessel 30.

Suitable provisions can be added to weigh the ingredients before their introduction to mixing vessel 20. As examples, a hydraulic pressure transducer could be added to the input lines to hydraulic cylinders 17 and/or 56, a load cell could be added to mixing vessel 20 to abut with link 52 or similar element, or the like.

Now that the basic construction of device D has been set forth, its operation and some of its features can be highlighted. Specifically, device D is mounted to loader 10 by the removable attachment of mount 26 to attachment base 12 by any known manner. Power for motor 34 and hydraulic cylinder 56 is suitably connected to the control system of loader 10. By actuating hydraulic cylinders 17, loader arms 14 and device D are raised vertically and by actuating hydraulic cylinders 19, attachment base 12 and mixing vessel 20 can be moved to be vertically oriented. Thus, with wheels 13, device D can be moved vertically, horizontally and angularly relative to the ground.

Device D can be moved to adjacent a first ingredient, such as sand, to be added to mixing vessel 20. Hydraulic cylinder 56 is actuated to tip measuring bucket 40 into the loading position such that clam shell 94A of measuring bucket 40 is parallel to and abuts the ground, with the open top generally perpendicular to the ground, and with the bottom end intermediate the open top and mixing vessel 20. Loader 10 is then moved forward to push measuring bucket 40 into the first ingredient, thereby filling measuring bucket 40.

Depending upon the amount of the first ingredient desired, clam shells 94A and 94B can be in the first, intermediate or maximum position.

A liquid, such as water, can be added to arcuate basin 76 to a level up to opening 78, thereby measuring a standard amount of liquid to be added to mixing vessel 20.

After measuring bucket 40 and arcuate basin 76 are filled, hydraulic cylinder 56 is actuated to raise measuring bucket 40 into the transport position. As pickup arms 42 are raised and due to the positioning of axis 46 adjacent the open end of clam shells 94A and 94B of measuring bucket 40, measuring bucket 40 has a vertical orientation spaced from and parallel to mixing vessel 20 and with the open top above the closed bottom.

Due to linkage 80, as pickup arms 42 are raised, lid 70 pivots relative to mixing vessel 20 from the closed position to the open position such that the liquid contained in arcuate basin 76 flows through opening 78 into mixing vessel 20. With continued raising of pickup arms 42, lid 70 is in its open position, and measuring bucket 40 engages peripheral edge 72 to tip measuring bucket 40 into the emptying positions, allowing the first ingredient to flow from measuring bucket 40 into mixing vessel 20. In the emptying position, the open top of measuring bucket 40 is located within the upper peripheral edge of mixing vessel 20 and with the open top intermediate the closed bottom and the mixing vessel 20.

After emptying the first ingredient from measuring bucket 40 into mixing vessel 20, hydraulic cylinder 56 is actuated to move measuring bucket 40 in front of mixing vessel 20 and lowering lid 70 unto mixing vessel 20.

Device D can be moved to adjacent a second ingredient, such as aggregate, to be added to mixing vessel 20. Hydraulic cylinder 56 is actuated to tip measuring bucket 40 such that clam shell 94A is parallel to and abuts the ground. Loader 10 is then moved forward to push measuring bucket 40 into the second ingredient, thereby filling measuring bucket 40. Depending upon the amount of the second ingredient desired, clam shells 94A and 94B can be in the first, intermediate or maximum position.

If desired, further liquid, such as water, can be added to arcuate basin 76 to a level up to opening 78, thereby measuring a standard amount of further liquid to be added to mixing vessel 20.

After measuring bucket 40 and arcuate basin 76 are filled, hydraulic cylinder 56 is actuated to raise measuring bucket 40. As pickup arms 42 are raised and due to the positioning of axis 46 adjacent the open end of clam shells 94A and 94B of measuring bucket 40, measuring bucket 40 has a vertical orientation.

Due to linkage 80, as pickup arms 42 are raised, lid 70 pivots relative to mixing vessel 20 such that the liquid contained in arcuate basin 76 flows through opening 78 into mixing vessel 20. With continued raising of pickup arms 42, measuring bucket 40 engages peripheral edge 72 to tip measuring bucket 40, allowing the second ingredient to flow from measuring bucket 40 into mixing vessel 20.

After emptying the second ingredient from measuring bucket 40 into mixing vessel 20, hydraulic cylinder 56 is actuated to move measuring bucket 40 in front of mixing vessel 20 and lowering lid 70 unto mixing vessel 20.

Additional ingredients, such as a cement mixture, can be added to mixing vessel 20, such as, by utilizing measuring bucket 40 in a similar manner or by simply adding such additional ingredient to mixing vessel 20 by dumping therein with lid 70 pivoted to an open position.

Before, during, and/or after adding 16 ingredients, motor 34 can be actuated for rotating shaft 28 and mixing paddles 30 inside of mixing vessel 20, mixing the ingredients in mixing vessel 20. Loader 10 can be moved, moving device D to adjacent the dispensing location where the mixed ingredients are desired to be dispensed. Loader arms 14 can be pivoted by hydraulic cylinders 17 such that device is located at a desired elevation. At that time, gate 90 can be moved from the closed position to the open position, allowing flow of mixed ingredients out of mixing vessel 20 to the dispensing location, including by being directed by the chute thereto.

It should be appreciated that adding the bulk ingredients to mixing vessel 20 is done mechanically by a single operator sitting in cab 16. The mixed ingredients are dispensed directly from mixing vessel 20 through gate 90, without requiring dumping the mixed ingredients by tipping mixing vessel 20 into a wheel barrow which then must be moved. Thus, device D loads, mixes, and delivers the mixed ingredients by mechanizing many stops and reducing labor requirements.

Thus, since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. Device comprising, in combination: a mixing vessel including an open, upper peripheral edge, a gate moveable between a closed position and an open position allowing communication with an interior of the mixing vessel, a shaft extending through the interior of the mixing vessel, mixing paddles extending radially from the shaft and inside the interior, and a mount secured to the mixing vessel, with the mount configured to allow movement of the mixing vessel vertically and angularly with respect to ground; a measuring bucket movable with respect to the mixing vessel, with the measuring bucket including an open top and a closed bottom, with the measuring bucket moveable from a loading position with the measuring bucket abutting the ground, with the open top generally perpendicular to the ground, and with the closed bottom intermediate the open top and the mixing vessel, a transport position with the measuring bucket spaced from and parallel to the mixing vessel and with the open top above the closed bottom, and an emptying position with the open top located within the upper peripheral edge and with the open top intermediate the closed bottom and the mixing vessel; first and second pickup arms having first ends pivotably mounted to the mixing vessel about an arm axis and having second ends pivotably mounted to the measuring bucket about a bucket axis spaced from and parallel to the arm axis, with the measuring bucket pivotable about the bucket axis between the loading, transport and emptying positions with pivotal mount of the first and second pickup arms about the arm axis; and a linkage having a first end pivotably mounted to the first pickup arm about a linkage axis spaced from and parallel to the arm and bucket axes and having a second end pivotably mounted to the lid about a lid axis, with the lid movable between the closed position and the open position with the pivotal mount of the first and second pickup arms about the arm axis.

2. The device as claimed in claim 1, further comprising, in combination: a loader movable relative to the ground, with the loader including loader arms pivotable relative to a cab, and a positioning base pivotable relative to the loader arms, with the mount removably attached to the positioning base.

3. The device as claimed in claim 1, wherein the measuring bucket comprises first and second clam shells having top ends and having bottom ends pivotable relative to each other about a clam axis parallel to and spaced from the bucket axis and the arm, linkage, and lid axes, with the top end of the first clam shell having a scraping blade abutting with and slideable along the ground, with the first and second clam shells being positionable in one of a first position, an intermediate position, and a maximum position, with the measuring bucket in the first position, in the intermediate position, and in the maximum position including an open top defined by the top ends of the first and second clam shells and a closed bottom defined by the bottom ends of the first and second clam shells, with the top ends of the first and second clam shells being spaced a first distance in the first position, with the top ends of the first and second clam shells being a greater distance than the first distance in the intermediate position, with the top ends of the first and second clam shells being a greatest distance larger than the greater distance in the maximum position.

4. The device as claimed in claim 3, further comprising, in combination: a first link having a first end pivotable relative to the mixing vessel about a first link axis parallel to and spaced from the arm, linkage, bucket and clam axes and having a second end; a second link having a first end pivotable relative to the one of the first and second pickup arms about a second link axis parallel to and spaced from the first link, arm, linkage, bucket and clam axes and having a second end; and a hydraulic cylinder having a first end pivotable relative to the mixing vessel about a cylinder axis parallel to and spaced from the first link, second link, arm, linkage, bucket and clam axes and having a second end, with the second ends of the first and second links and of the hydraulic cylinder pivotably connected about a connection axis parallel to and spaced from the first link, second link, arm, linkage, bucket, clam and cylinder axes.

5. The device as claimed in claim 1, further comprising, in combination: a first link having a first end pivotable relative to the mixing vessel about a first link axis parallel to and spaced from the arm and bucket axes and having a second end; a second link having a first end pivotable relative to the one of the first and second pickup arms about a second link axis parallel to and spaced from the first link, arm and bucket axes and having a second end; and a hydraulic cylinder having a first end pivotable relative to the mixing vessel about a cylinder axis parallel to, and spaced from, the first link, second link, arm and bucket axes and having a second end, with the second ends of the first and second links and of the hydraulic cylinder pivotably connected about a connection axis parallel to and spaced from the first link, second link, arm, bucket and cylinder axes.

6. The device as claimed in claim 5, further comprising, in combination: a pivotal follower having a first end and having a second end pivotably mounted to one of the first and second pickup arms about a follower axis intermediate, parallel to, and spaced from the arm and bucket axes; a tie having a first end pivotably mounted to the measuring bucket about a first tie axis intermediate and spaced from the open top and the closed bottom and spaced from and parallel to the follower, arm and bucket axes and having a second end pivotably mounted to the pivotal follower about a second tie axis intermediate and spaced from the first and second ends of the pivotal follower and spaced from and parallel to the first tie, follower, arm and bucket axes, with the pivotal follower camming upon the open, upper peripheral edge as the measuring bucket moves from the transport position to the emptying position.

7. The device as claimed in claim 5, further comprising, in combination: a lid abutting with the open, upper peripheral edge, with the lid movable with respect to the mixing vessel and movable with respect to the measuring bucket between a closed position and an open position, with the lid in the closed position abutting with the open, upper peripheral edge and closing the interior of the mixing vessel and when the measuring bucket is in the loading position, and with the lid in the open position being spaced from the open, upper peripheral edge and when the measuring bucket is in the emptying position.

8. The device as claimed in claim 7, wherein the lid includes a peripheral rim and an arcuate basin depressed within the peripheral rim and located opposite to the interior when the lid is in the closed position, with the arcuate basin including an opening in communication with the interior of the mixing vessel in the closed position.

9. The device as claimed in claim 8, wherein the lid is hingedly connected between the peripheral rim and the open, upper peripheral edge about an edge axis and pivotal between the closed position and the open position, with the edge axis located on an opposite side of the open, upper peripheral edge with the measuring bucket in the emptying position.

10. The device as claimed in claim 5, wherein the measuring bucket comprises first and second clam shells having top ends and having bottom ends pivotable relative to each other about a clam axis parallel to and spaced from the bucket axis and the edge, arm, linkage, and lid axes, with the top end of the first clam shell having a scraping blade abutting with and slideable along the ground, with the first and second clam shells being positionable in one of a first position, an intermediate position, and a maximum position, with the measuring bucket in the first position, in the intermediate position, and in the maximum position including an open top defined by the top ends of the first and second clam shells and a closed bottom defined by the bottom ends of the first and second clam shells, with the top ends of the first and second clam shells being spaced a first distance in the first position, with the top ends of the first and second clam shells being a greater distance than the first distance in the intermediate position, with the top ends of the first and second clam shells being a greatest distance larger than the greater distance in the maximum position.

11. Device comprising, in combination: a mixing vessel including an open, upper peripheral edge, a gate moveable between a closed position and an open position allowing communication with an interior of the mixing vessel, a shaft extending through the interior of the mixing vessel, mixing paddles extending radially from the shaft and inside the interior, and a mount secured to the mixing vessel, with the mount configured to allow movement of the mixing vessel vertically and angularly with respect to ground; and a measuring bucket movable with respect to the mixing vessel, with the measuring bucket including an open top and a closed bottom, with the measuring bucket moveable from a loading position with the measuring bucket abutting the ground, with the open top generally perpendicular to the ground, and with the closed bottom intermediate the open top and the mixing vessel, a transport position with the measuring bucket spaced from and parallel to the mixing vessel and with the open top above the closed bottom, and an emptying position with the open top located within the upper peripheral edge and with the open top intermediate the closed bottom and the mixing vessel, wherein the measuring bucket comprises first and second clam shells having top ends and having bottom ends pivotable relative to each other about a clam axis, with the top end of the first clam shell having a scraping blade abutting with and slideable along the ground, with the first and second clam shells being positionable in one of a first position, an intermediate position, and a maximum position, with the measuring bucket in the first position, in the intermediate position, and in the maximum position including an open top defined by the top ends of the first and second clam shells and a closed bottom defined by the bottom ends of the first and second clam shells, with the top ends of the first and second clam shells being spaced a first distance in the first position, with the top ends of the first and second clam shells being a greater distance than the first distance in the intermediate position, with the top ends of the first and second clam shells being a greatest distance larger than the greater distance in the maximum position.

12. The device as claimed in claim 11, further comprising, in combination: first and second pickup arms having first ends pivotably mounted to the mixing vessel about an arm axis spaced from and parallel to the edge axis and having second ends pivotably mounted to the measuring bucket about a bucket axis spaced from and parallel to the edge axis and to the arm axis, with the measuring bucket pivotable about the bucket axis between the loading, transport and emptying positions with pivotal movement of the first and second pickup arms about the arm axis.

13. The device as claimed in claim 12, further comprising, in combination: a linkage having a first end pivotably mounted to the first pickup arm about a linkage axis spaced from and parallel to the edge, arm, and bucket axes and having a second end pivotably mounted to the lid about a lid axis, with the lid movable between the closed position and the open position with the pivotal movement of the first and second pickup arms about the arm axis.

14. The device as claimed in claim 11, further comprising, in combination: a bar with the clam and bucket axes extending through the bar; a bar opening extending through the bar; first and second clam apertures extending through the first and second clam shells; and a pin extendable to one or more of the bar aperature and the first and second clam apertures.

15. The device as claimed in claim 14, further comprising, in combination: a first link having a first end pivotable relative to the mixing vessel about a first link axis parallel to and spaced from the edge, arm, linkage, bucket and clam axes and having a second end; a second link having a first end pivotable relative to the one of the first and second pickup arms about a second link axis parallel to and spaced from the first link, edge, arm, linkage, bucket and clam axes and having a second end; and a hydraulic cylinder having a first end pivotable relative to the mixing vessel about a cylinder axis parallel to and spaced from the first link, second link, edge, arm, linkage, bucket and clam axes and having a second end, with the second ends of the first and second links and of the hydraulic cylinder pivotably connected about a connection axis parallel to and spaced from the first link, second link, edge, arm, linkage, bucket, clam and cylinder axes.

* * * * *